US010577149B2

(12) United States Patent
Zimmerman et al.

(10) Patent No.: US 10,577,149 B2
(45) Date of Patent: Mar. 3, 2020

(54) POLYMERIC FORMED STRUCTURAL COMPONENTS FOR PALLETS

(71) Applicant: SR Systems, LLC, Tuscaloosa, AL (US)

(72) Inventors: Steve Zimmerman, Linden, AL (US); Scott Drummond, Tuscaloosa, AL (US); Van T. Walworth, Rockwood, TN (US)

(73) Assignee: SR Systems, LLC, Tuscaloosa, AL (US)

( * ) Notice: Subject to any disclaimer, the term of this patent is extended or adjusted under 35 U.S.C. 154(b) by 0 days.

(21) Appl. No.: 16/142,735

(22) Filed: Sep. 26, 2018

(65) Prior Publication Data

US 2019/0092521 A1 Mar. 28, 2019

Related U.S. Application Data

(60) Provisional application No. 62/564,321, filed on Sep. 28, 2017.

(51) Int. Cl.
*B65D 19/38* (2006.01)
*B65D 19/00* (2006.01)

(52) U.S. Cl.
CPC ..... *B65D 19/0038* (2013.01); *B65D 2519/00034* (2013.01); *B65D 2519/00069* (2013.01); *B65D 2519/00104* (2013.01); *B65D 2519/00273* (2013.01); *B65D 2519/00288* (2013.01); *B65D 2519/00308* (2013.01); *B65D 2519/00318* (2013.01); *B65D 2519/00333* (2013.01); *B65D 2519/00368* (2013.01); *B65D 2519/00572* (2013.01)

(58) Field of Classification Search
CPC ..... B65D 2519/00333; B65D 2519/00572
USPC ..... 108/57.25, 57.33
See application file for complete search history.

(56) References Cited

U.S. PATENT DOCUMENTS 3,148,637 A * 9/1964 Lund ..... B65D 19/0026 108/53.1
4,735,154 A * 4/1988 Hemery ..... B65D 19/0012 108/56.1
5,191,843 A * 3/1993 Ausavich ..... B65D 19/0026 108/56.1
5,351,628 A * 10/1994 Breezer ..... B65D 19/0022 108/56.1

(Continued)

*Primary Examiner* — Matthew W Ing
(74) *Attorney, Agent, or Firm* — Harness, Dickey & Pierce, P.L.C.

(57) ABSTRACT

A pallet comprising upper and lower platforms connected by a plurality of blocks. The upper platform includes a plurality of upper platform pedestals and the lower platform includes a plurality of lower platform pedestals. The lower platform pedestals are aligned with the upper platform pedestals such that the lower platform pedestals and the upper platform pedestals extend towards one another. The plurality of blocks interlockingly engage with and extend between the upper and lower platform pedestals to connect the upper and lower platforms. Each block includes an upper recess and a lower recess. The upper recess matches the shape of and receives one of the upper platform pedestals. The lower recess matches the shape of and receives one of the lower platform pedestals. The upper platform, the lower platform, and the plurality of blocks are made of a polymeric material.

20 Claims, 9 Drawing Sheets

(56) References Cited

U.S. PATENT DOCUMENTS

| | | | | |
|---|---|---|---|---|
| 5,388,533 | A * | 2/1995 | Pigott | B65D 19/0012 108/56.1 |
| 5,413,052 | A * | 5/1995 | Breezer | B65D 19/0012 108/56.1 |
| 5,590,606 | A * | 1/1997 | Crews | B65D 19/0012 108/51.3 |
| 6,536,996 | B2 * | 3/2003 | Satran | B23C 5/1045 407/113 |
| 6,564,725 | B2 * | 5/2003 | Hale | B65D 19/0012 108/56.1 |
| 2003/0233963 | A1 * | 12/2003 | Fan | B65D 19/0012 108/51.11 |
| 2004/0216648 | A1 * | 11/2004 | Apps | B65D 19/0012 108/57.25 |
| 2005/0056193 | A1 * | 3/2005 | Laender | B65D 19/0081 108/56.3 |
| 2011/0192326 | A1 * | 8/2011 | Ingham | B65D 19/0048 108/57.17 |
| 2016/0235222 | A1 * | 8/2016 | Atkins | A47F 10/06 |

* cited by examiner

POLYMERIC FORMED STRUCTURAL COMPONENTS FOR PALLETS

CROSS REFERENCE TO RELATED APPLICATIONS

This application claims the benefit of U.S. Provisional Application No. 62/564,321 filed on Sep. 28, 2017. The entire disclosure of the above referenced application is incorporated herein by reference.

FIELD

The subject disclosure generally relates to polymeric structure components and more particularly to polymeric structure components used to construct pallets.

BACKGROUND

This section provides background information related to the present disclosure and is not necessarily prior art.

Fork lift pallets are widely used across the construction and transportation industry as well as most every industry in the business of moving things from one place to another. Fork lift pallets are traditionally made of wood or metal. In recent years, alternative materials have been introduced into the marketplace competing with wood and metal pallets. However, these alternative materials are not durable enough to survive a long service life and must be replaced and/or repaired frequently, incurring excessive costs. Pallets made of alternative materials can also be expensive to manufacture and heavy, making them cost prohibitive to purchase and more expensive to ship. As a result, there remains a need for improved pallets that are made of alternative materials to wood and metal.

SUMMARY

This section provides a general summary of the disclosure, and is not a comprehensive disclosure of its full scope or all of its features.

Polymeric formed structural components are disclosed herein for use in the general construction industry to replace or provide additional structural integrity to wood frame substrates. Specialized fork lift pallets and/or containers can be formed of polymeric structural components for use in the transportation/shipping industry. Brackets and other specially shaped structural components can be made of polymeric materials for specific applications where bolted and/or nailed connections between building components are desired and/or required. In addition, ballistic type panels can be formed of polymeric materials to provide penetration resistance from high wind storm debris projectiles. Polymeric material is formed by pressing, melting, injection, casting, and/or combinations of several fabrication methods to yield durable, corrosion resistant, electrically non-conductive, spilt and tear resistant components. Such polymeric structural components can be nailed and/or screwed together without starter holes because of the split resist characteristics of the material. Formed holes for bolts may also be provided.

In accordance with one aspect of the present disclosure, an improved pallet design is provided. The pallet comprises an upper platform and a lower platform that are connected by a plurality of blocks. The upper platform extends in and is bisected by a first plane and the lower platform extends in and is bisected by a second plane that is parallel to and spaced apart from the first plane. The upper platform has a pair of upper platform ends, a pair of upper platform sides, an exterior surface, and an interior surface. The upper platform includes a plurality of upper platform pedestals that protrude from the interior surface of the upper platform and extend away from the first plane. The lower platform has a pair of lower platform ends, a pair of lower platform sides, an outside surface, and an inside surface. The upper and lower platforms are arranged such that the interior surface of the upper platform faces the inside surface of the lower platform. The lower platform includes a plurality of lower platform pedestals that protrude from the inside surface of the lower platform and extend away from the second plane. The lower platform pedestals are aligned with the upper platform pedestals such that the lower platform pedestals and the upper platform pedestals extend towards one another. A plurality of blocks are interlockingly engaged with and extend between the upper and lower platform pedestals to connect the upper and lower platforms. Each block in the plurality of blocks includes an upper recess and a lower recess. The upper recess matches the shape of and receives one of the upper platform pedestals. The lower recess matches the shape of and receives one of the lower platform pedestals. In accordance with one aspect of the subject disclosure, the upper platform, the lower platform, and the plurality of blocks are made of a polymeric material.

Optionally, the upper platform may include a plurality of upper platform holes that are aligned with and extend through the plurality of upper platform pedestals. Similarly, the lower platform may include a plurality of lower platform holes that are aligned with and extend through the plurality of lower platform pedestals. In accordance with this aspect of the subject disclosure, each block in the plurality of blocks may include a through-bore that is aligned with one of the upper platform holes and one of the lower platform holes. A plurality of fasteners are aligned with and extend through the plurality of upper platform holes, the through-bores in the plurality of blocks, and the plurality of lower holes to secure the upper platform, the lower platform, and the plurality of blocks together.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION

Figure 1:
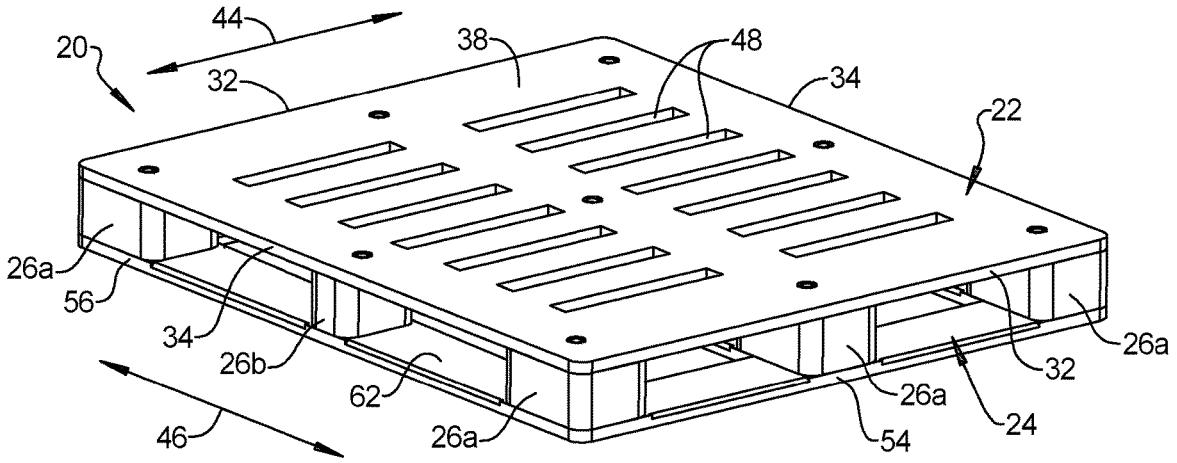
FIG. 1 is a side perspective view of a pallet constructed of exemplary polymeric structural components in accordance with the present disclosure.

Referring to the Figures, wherein like numerals indicate corresponding parts throughout the several views, several polymeric structural components for constructing pallets in accordance with the subject disclosure are illustrated.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly. In addition, the term "rectangular" as used herein is inclusive of both rectangular and square shapes.

Figure 2:
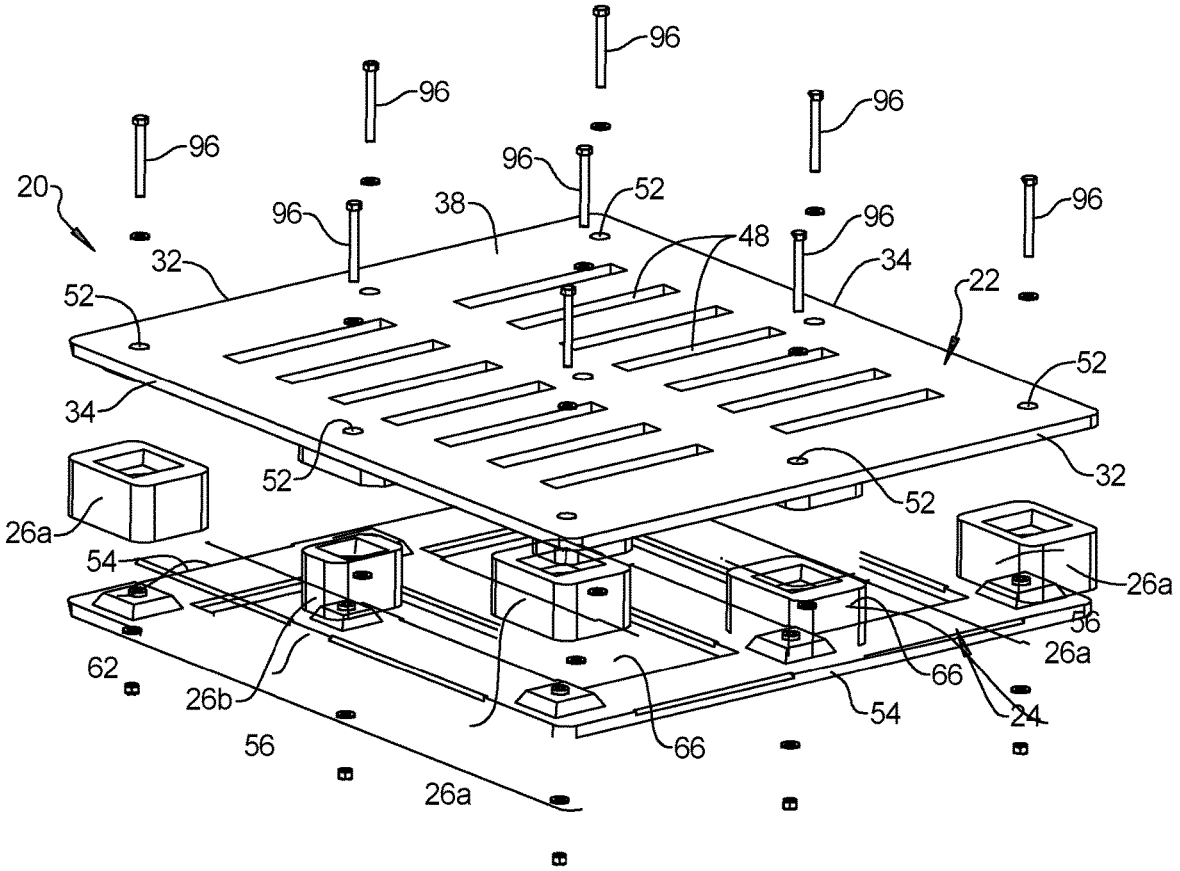
FIG. 2 is an exploded perspective view of the pallet shown in FIG. 1.
Figure 3:
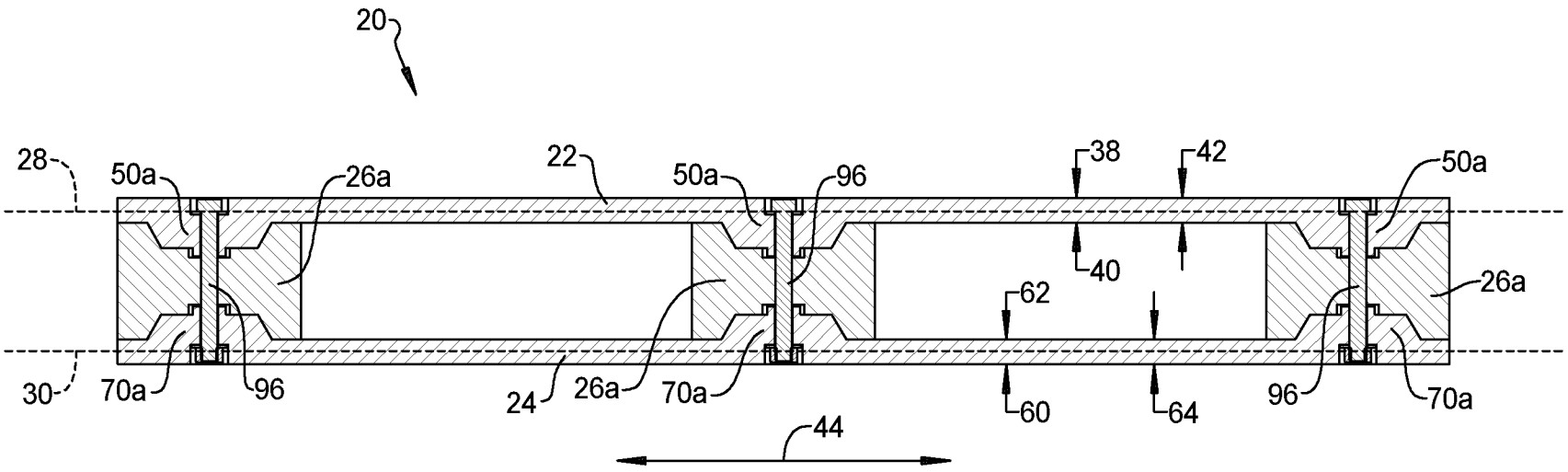
FIG. 3 is a front cross-sectional view of the pallet shown in FIG. 1.
Figure 4:
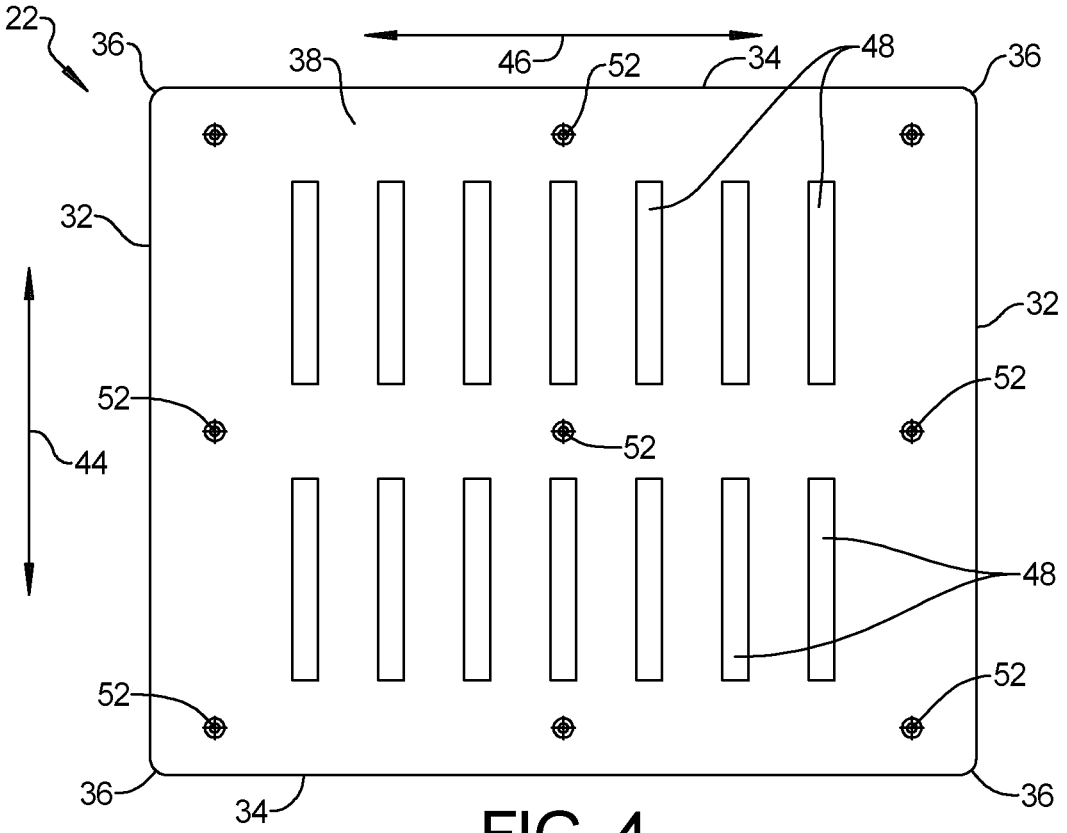
FIG. 4 is a top plan view of one of the exemplary polymeric structural components in FIG. 1, which forms an upper platform of the pallet shown in FIG. 1.
Figure 5:
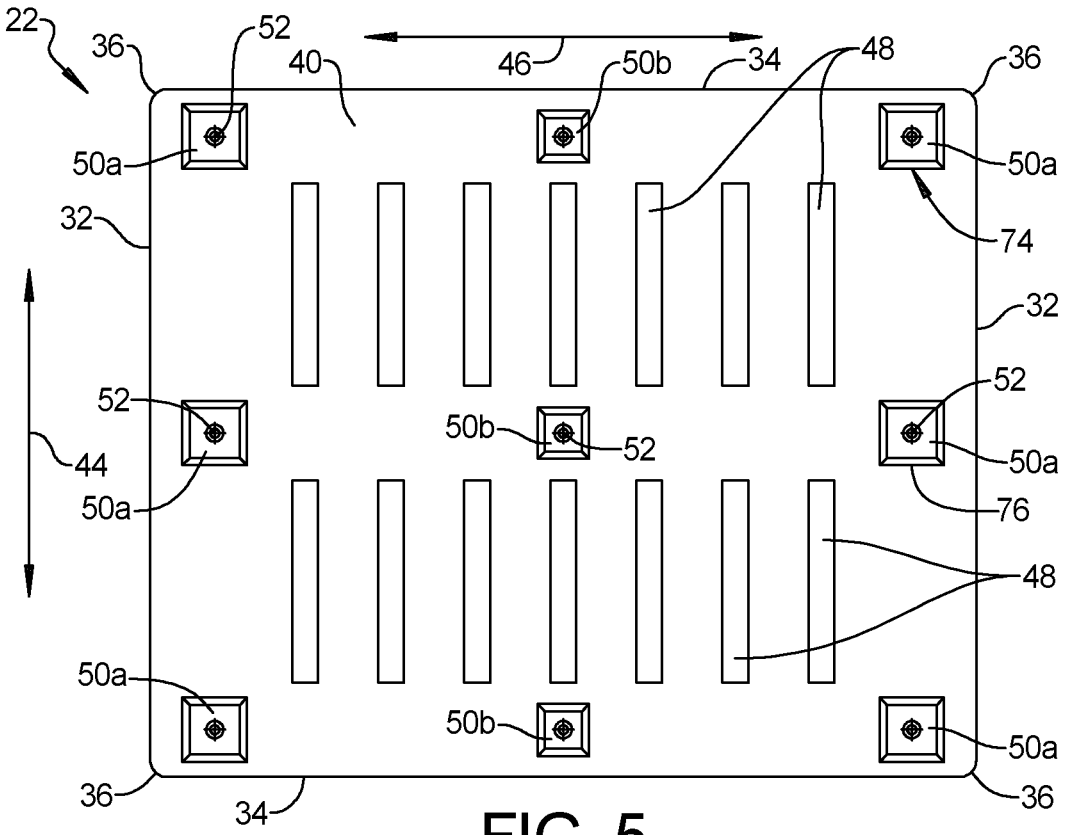
FIG. 5 is a bottom plan view of the exemplary polymeric structural component shown in FIG. 4.
Figure 6:
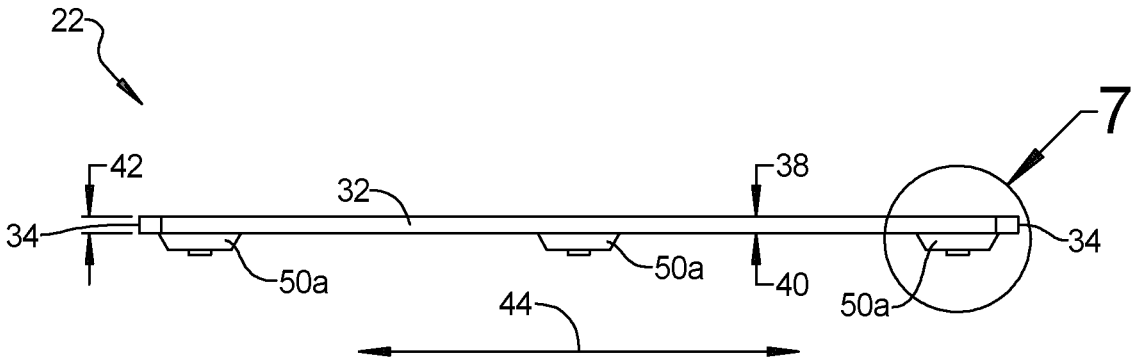
FIG. 6 is a front elevation view of the exemplary polymeric structural component shown in FIG. 4.
Figure 7:
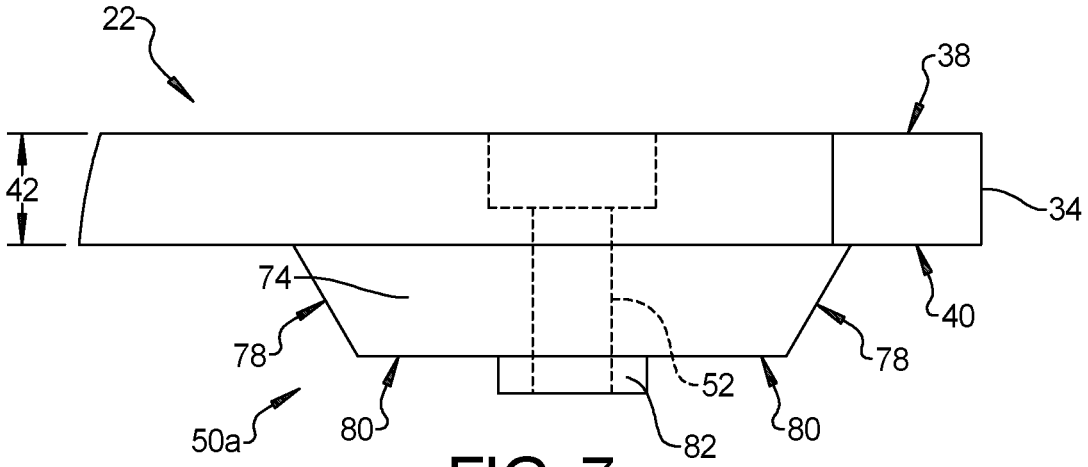
FIG. 7 is an enlarged front elevation view of a portion of the exemplary polymeric structural component shown in FIG. 6.
Figure 8:
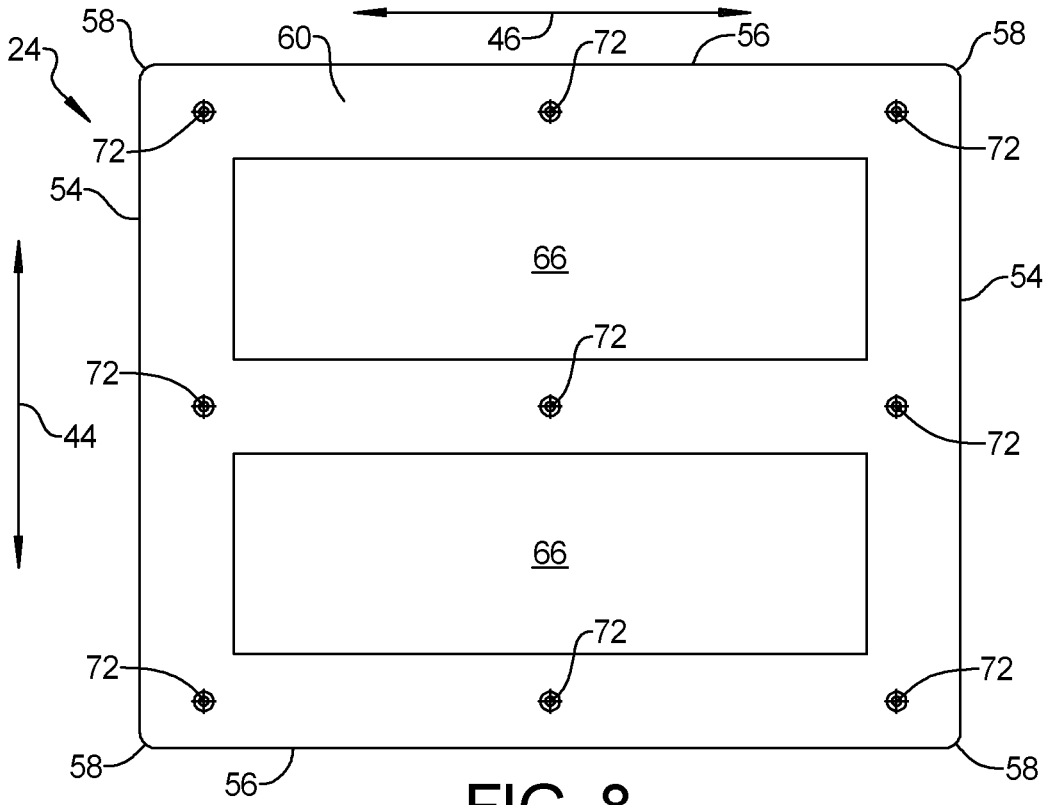
FIG. 8 is a bottom plan view of another one of the exemplary polymeric structural components in FIG. 1, which forms a lower platform of the pallet shown in FIG. 1.
Figure 9:
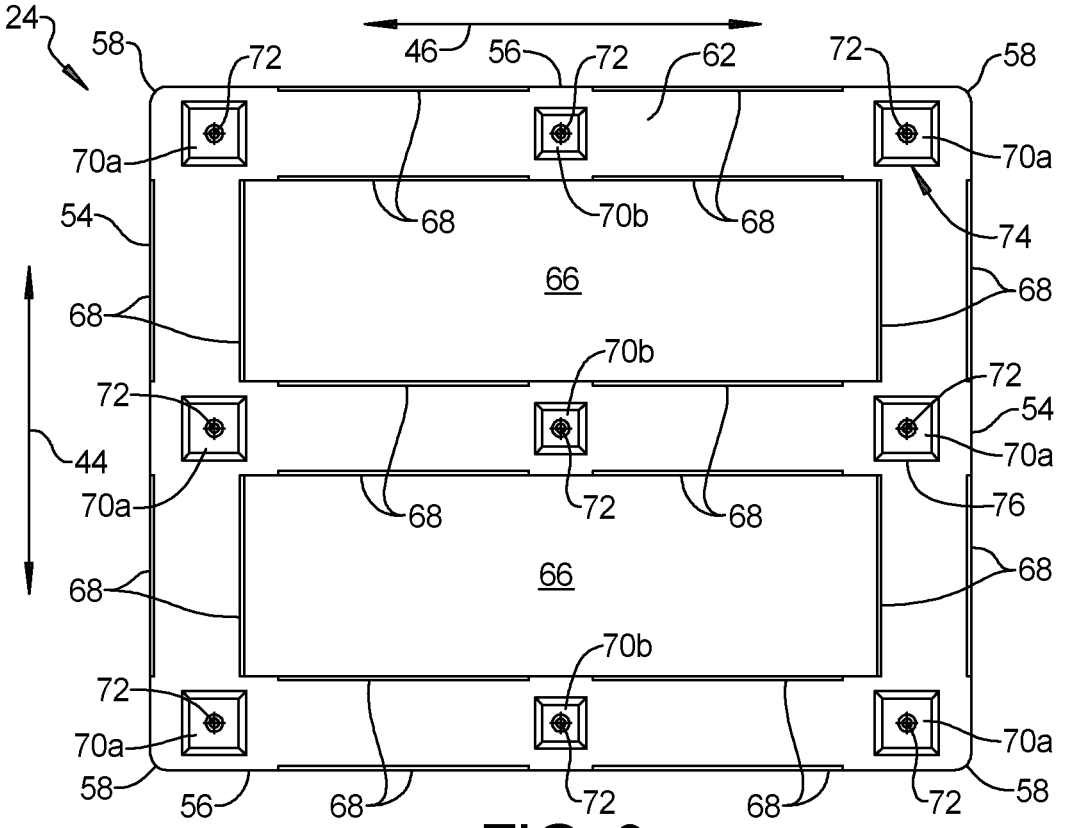
FIG. 9 is a top plan view of the exemplary polymeric structural component shown in FIG. 8.
Figure 10:
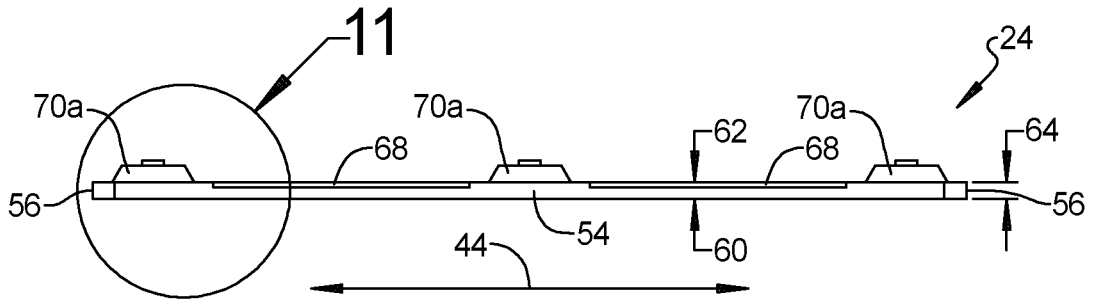
FIG. 10 is a front elevation view of the exemplary polymeric structural component shown in FIG. 8.
Figure 11:
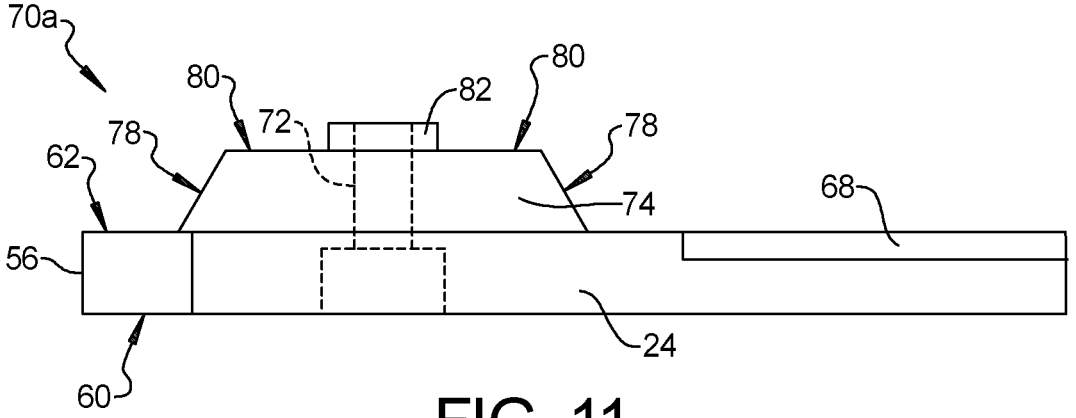
FIG. 11 is an enlarged front elevation view of a portion of the exemplary polymeric structural component shown in FIG. 10.
Figure 12:
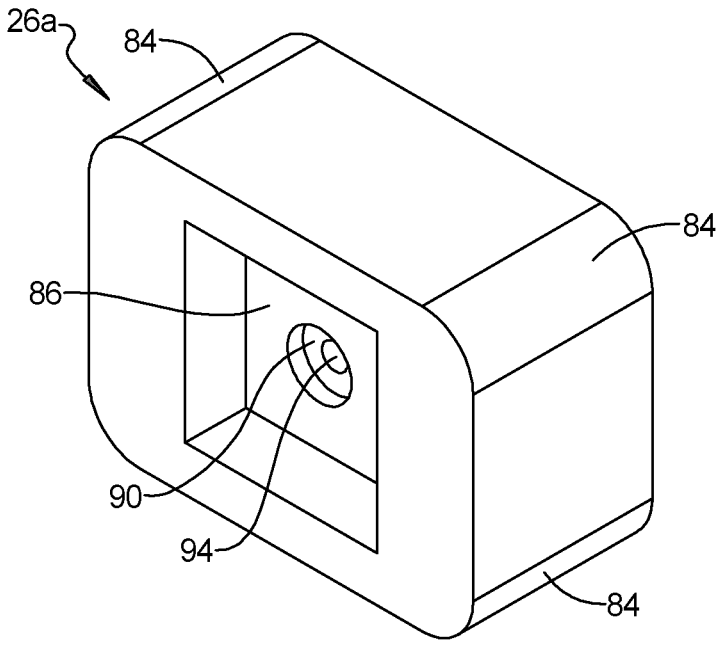
FIG. 12 is a top perspective view of another one of the exemplary polymeric structural components in FIG. 1, which forms an end block of the pallet shown in FIG. 1.
Figure 13:
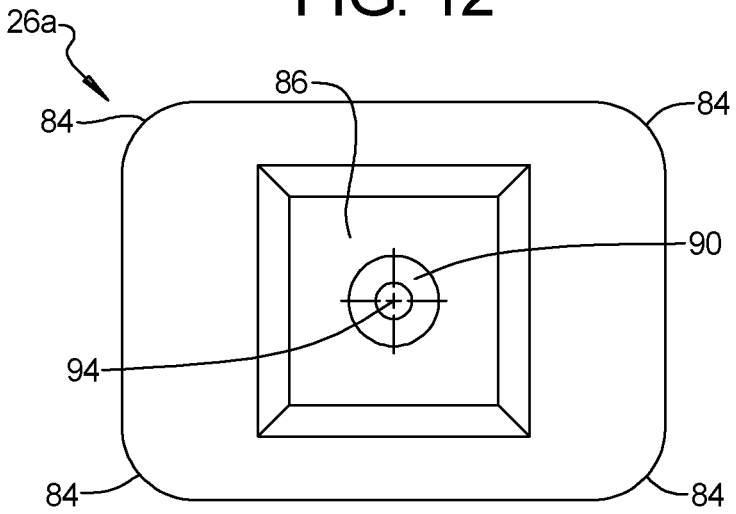
FIG. 13 is a top plan view of the exemplary polymeric structural component shown in FIG. 12.

FIGS. 1-3 illustrate a pallet 20 constructed in accordance with the present disclosure. The pallet 20 comprises an upper platform 22 and a lower platform 24 that are connected by a plurality of blocks 26*a*, 26*b*. The upper platform 22 extends in and is bisected by a first plane 28 and the lower platform 24 extends in and is bisected by a second plane 30 that is parallel to and spaced apart from the first plane 28.

With additional reference to FIGS. 4-7, the upper platform 22 has a rectangular shape with a pair of upper platform ends 32, a pair of upper platform sides 34, and rounded corners 36. The upper platform 22 also has an exterior surface 38 and an interior surface 40. The exterior surface 38 of the upper platform 22 is parallel to the first plane 28 and is designed to face up and support a cargo load placed on the pallet 20 when the pallet 20 is in use. The interior surface 40 of the upper platform 22 is parallel to the first plane 28 and is spaced apart from the exterior surface 38 by an upper platform thickness 42. The pair of upper platform ends 32 extend laterally (i.e., in a lateral direction 44) between the pair of upper platform sides 34 and the pair of upper platform sides 34 extend longitudinally (i.e., in a longitudinal direction 46) between the pair of upper platform ends 32. Although other configurations are possible, in the illustrated example, the upper platform 22 includes a plurality of slots 48 that extend through the entire upper platform thickness 42. The slots 48 in the upper platform 22 are longitudinally spaced apart (i.e., spaced apart in the longitudinal direction 46) and run parallel to the upper platform ends 32. It should be appreciated that the slots 48 in the upper platform 22 may be arranged in a variety of different configurations. In the example illustrated, the plurality of slots 48 are arranged in the upper platform 22 in two laterally spaced apart groups (i.e., the groups of slots 48 are spaced apart in the lateral direction 44).

The upper platform 22 includes a plurality of upper platform pedestals 50*a*, 50*b* that protrude from the interior surface 40 of the upper platform 22 and extend away from the first plane 28. Although other configurations are possible, in the illustrate example, the upper platform pedestals 50*a*, 50*b* are arranged adjacent to the upper platform ends 32 and the upper platform sides 34. In addition, at least one upper platform pedestal 50*b* is arranged between the laterally spaced apart groups of slots 48. The plurality of upper platform pedestals 50*a*, 50*b* include a first group of upper platform pedestals 50*a* that are positioned adjacent to the pair of upper platform ends 32 and a second group of upper platform pedestals 50*b* that are positioned longitudinally between the first group of upper platform pedestals 50*a*. The second group of upper platform pedestals 50*b* have a smaller perimeter than the first group of upper platform pedestals 50*a*. Although the number of upper platform pedestals 50*a*, 50*b* may vary, in accordance with the preferred embodiment illustrated, there are a total of six upper platform pedestals 50*a* in the first group of upper platform pedestals 50*a* and there are a total of three upper platform pedestals 50*b* in the second group of upper platform pedestals 50*b*. Accordingly, there are a total of nine upper platform pedestals 50*a*, 50*b* in the illustrated example.

The upper platform 22 also includes a plurality of upper platform holes 52 that are arranged adjacent to the upper platform ends 32 and the upper platform sides 34. In addition, at least one upper platform hole 52 is arranged between the laterally spaced apart groups of slots 48. The plurality of upper platform holes 52 are aligned with and extend through the plurality of upper platform pedestals 50*a*, 50*b* such that each upper platform pedestal 50*a*, 50*b* includes one upper platform hole 52.

With additional reference to FIGS. 8-11, the lower platform 24 has a rectangular shape with a pair of lower platform ends 54, a pair of lower platform sides 56, and rounded corners 58. The lower platform 24 also has an outside surface 60 and an inside surface 62. The outside surface 60 of the lower platform 24 is parallel to the second plane 30 and is designed to face down and rest on the ground or some other support surface when the pallet 20 is in use. The inside surface 62 of the lower platform 24 is parallel to the second plane 30 and is spaced from the outside surface 60 by a lower platform thickness 64. The upper and lower platforms 22, 24 are arranged such that the interior surface 40 of the upper platform 22 faces the inside surface 62 of the lower platform 24. The pair of lower platform ends 54 extends laterally (i.e., in the lateral direction 44) between the pair of lower platform sides 56. The pair of lower platform sides 56 extend longitudinally (i.e., in the longitudinal direction 46) between the pair of lower platform ends 54. Although other configurations are possible, in the illustrated example, the lower platform 24 includes a pair of openings 66 that extend through the entire lower platform thickness 64. The pair of openings 66 in the lower platform 24 are laterally spaced apart (i.e., spaced apart in the lateral direction 44) and are rectangular in shape. Optionally, the lower platform 24 may include beveled edges 68 that extend along the pair of lower platform ends 54, the pair of lower platform sides 56, and/or the pair of openings 66.

The lower platform 24 includes a plurality of lower platform pedestals 70*a*, 70*b* that are arranged adjacent to the lower platform ends 54 and the lower platform sides 56. In addition, at least one lower platform pedestal 70*b* is arranged between the openings 66 in the lower platform 24. Each lower platform pedestal 70*a*, 70*b* protrudes from the inside surface 62 of the lower platform 24 and extends away from the second plane 30. The lower platform pedestals 70*a*, 70*b* are aligned with the upper platform pedestals 50*a*, 50*b* such that the lower platform pedestals 70*a*, 70*b* and the upper platform pedestals 50*a*, 50*b* extend towards one another. The plurality of lower platform pedestals 70*a*, 70*b* includes a first group of lower platform pedestals 70*a* that are positioned adjacent to the pair of lower platform ends 54 and a second group of lower platform pedestals 70*b* that are positioned longitudinally between the first group of lower platform pedestals 70*a*. The second group of lower platform pedestals 70*b* have a smaller perimeter than the first group of lower platform pedestals 70*a*. Although the number of lower platform pedestals 70*a*, 70*b* may vary, in accordance with the preferred embodiment illustrated, there are a total of six lower platform pedestals 70*a* in the first group of lower platform pedestals 70*a* and there are a total of three lower platform pedestals 70*b* in the second group of lower platform pedestals 70*b*. Accordingly, there are a total of nine lower platform pedestals 70*a*, 70*b* in the illustrated example.

The lower platform 24 includes a plurality of lower platform holes 72 that are arranged adjacent to the lower platform ends 54 and the lower platform sides 56. In addition, at least one lower platform hole 72 is arranged between the openings 66 in the lower platform 24. The plurality of lower platform holes 72 are aligned with and extend through the plurality of lower platform pedestals 70*a*, 70*b* such that each lower platform pedestal 70*a*, 70*b* includes one lower platform hole 72. The plurality of lower platform holes 72 are aligned with plurality of upper platform holes 52.

Each of the upper and lower platform pedestals 50*a*, 50*b*, 70*a*, 70*b* is shaped as a rectangular frustum 74 with a rectangular perimeter 76, tapered sides 78, and a flat rectangular end face 80. Each of the upper and lower platform pedestals 50*a*, 50*b*, 70*a*, 70*b* further includes a cylindrical projection 82 that is centrally located on the rectangular frustum 74. The cylindrical projections 82 on the upper platform pedestals 50*a*, 50*b* extend annularly about the upper platform holes 52 and the cylindrical projection 82 on the lower platform pedestals 70*a*, 70*b* extend annularly about the lower platform holes 72. In other words, the upper and lower platform holes 52, 72 extend co-axially through the cylindrical projections 82 on the upper and lower platform pedestals 50*a*, 50*b*, 70*a*, 70*b*.

Figure 14:
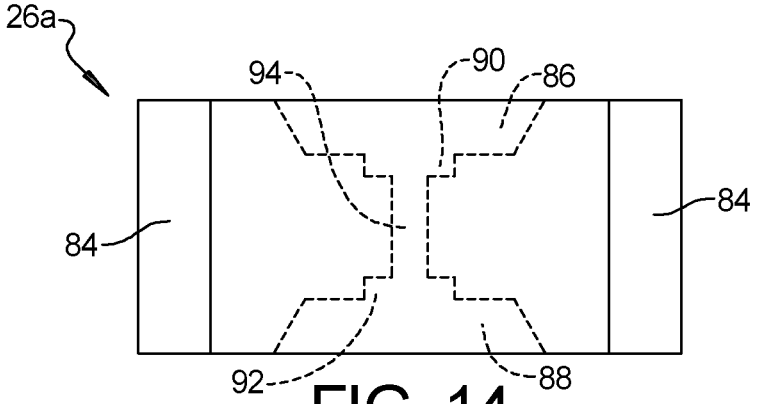
FIG. 14 is a side elevation view of the exemplary polymeric structural component shown in FIG. 12.
Figure 15:
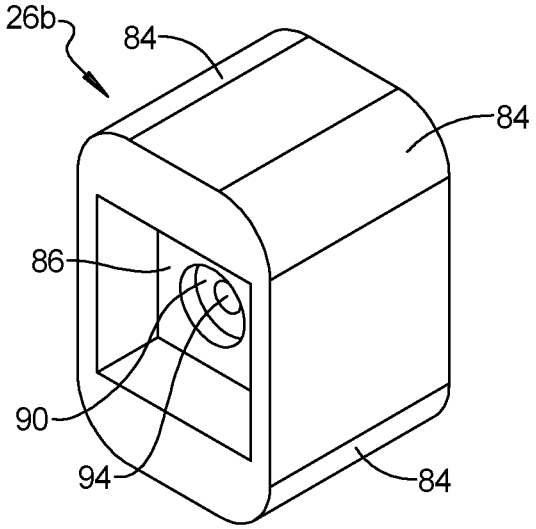
FIG. 15 is a top perspective view of another one of the exemplary polymeric structural components in FIG. 1, which forms a middle block of the pallet shown in FIG. 1.
Figure 16:
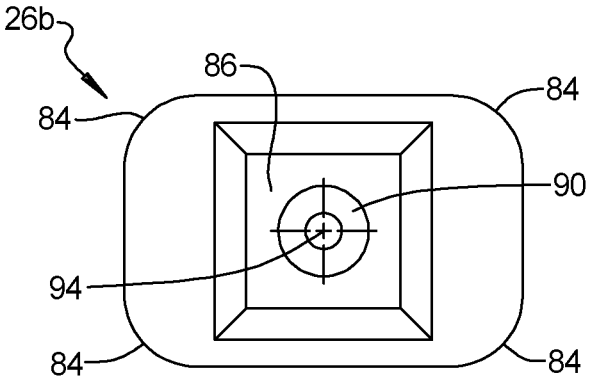
FIG. 16 is a top plan view of the exemplary polymeric structural component shown in FIG. 15.
Figure 17:
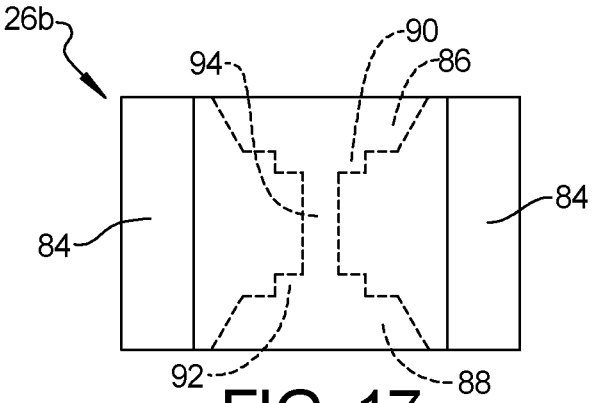
FIG. 17 is a front elevation view of the exemplary polymeric structural component shown in FIG. 15.

With additional reference to FIGS. 12-17, the plurality of blocks 26*a*, 26*b* that extend between the upper and lower platform pedestals 50*a*, 50*b*, 70*a*, 70*b* are shown. Although other configurations are possible, in the illustrated embodiment, each block 26*a*, 26*b* has a rectangular shape with rounded edges 84. The plurality of blocks 26*a*, 26*b* include upper and lower recesses 86, 88 that interlockingly engaged with the upper and lower platform pedestals 50*a*, 50*b*, 70*a*, 70*b*, respectively. The upper recess 86 of each block 26*a*, 26*b* matches the shape of and receives one of the upper platform pedestals 50*a*, 50*b*. Similarly, the lower recess 88 of each block 26*a*, 26*b* matches the shape of and receives one of the lower platform pedestals 70*a*, 70*b*. Each block 26*a*, 26*b* has an upper counter-bore 90 that is centrally located in the upper recess 86. The upper counter-bore 90 is aligned with and receives the cylindrical projection 82 of one of the upper platform pedestals 50*a*, 50*b*. Each block 26*a*, 26*b* also has a lower counter-bore 92 that centrally located in the lower recess 88. The lower counter-bore 92 is aligned with and receives the cylindrical projection 82 of one of the lower platform pedestals 70*a*, 70*b*. A through-bore 94 extends between the upper and lower counter-bores 90, 92 in each block 26*a*, 26*b*. As best seen in FIGS. 14 and 17, the upper and lower recesses 86, 88 give the plurality of blocks 26*a*, 26*b* a bow-tie like cross-sectional shape.

The plurality of blocks 26*a*, 26*b* includes a group of end blocks 26*a* that are positioned adjacent to the upper and lower platform ends 32, 54 and a group of middle blocks 26*b* that are positioned longitudinally between the group of end blocks 26*a*. The group of middle blocks 26*b* have a smaller perimeter than the group of end blocks 26*a*. The group of end blocks 26*a* are aligned with and extend between the first group of upper platform pedestals 50*a* and the first group of lower platform pedestals 70*a*. The group of middle blocks 26*b* are aligned with and extend between the second group of upper platform pedestals 50*b* and the second group of lower platform pedestals 70*b*. Although other configurations are possible, in the illustrated example, there are a total of six end blocks 26*a* in the group of end blocks 26*a* and there are a total of three middle blocks 26*b* in the group of middle blocks 26*b*. Accordingly, there are a total of nine blocks 26*a*, 26*b* in the illustrated example.

As shown in FIGS. 2 and 3, the pallet 20 includes a plurality of fasteners 96 that are aligned with and extend through the plurality of upper platform holes 52, the through-bores 94 in the plurality of blocks 26*a*, 26*b*, and the plurality of lower holes 52, 72 to secure the upper platform 22, the lower platform 24, and the plurality of blocks 26*a*, 26*b* together. In the illustrated embodiment, each fastener 96 in the plurality of fasteners 96 includes a bolt, a pair of washers, and a nut. However, it should be appreciated that other fasteners such as screws, nails, or staples can be used. When these other fasteners are used, the plurality of upper platform holes 52, the through-bores 94 in the plurality of blocks 26*a*, 26*b*, and the plurality of lower platform holes 72 can be eliminated. As another alternative, the structural components of the pallet 20 can be glued or bonded by an adhesive or an epoxy.

In accordance with the present disclosure, the upper platform 22, the lower platform 24, and the plurality of blocks 26*a*, 26*b* are made of a polymeric material. Polymeric materials such as high density polyethylene (HDPE) and/or other resin based polymers and/or epoxy like binders can be used. In addition, these polymeric materials can be infused with structural reinforcement ingredients, which provide improvement options that overcome the industry challenges previously articulated. By way of example and without limitation, polymeric materials can be infused with one or more reinforcement ingredients such as Nanospheres, glass, fibers, carbon fibers, and fiberglass. Wood-free pallets 20 provide insect resistance and non-metal pallets 20 provide salt spray corrosion resistance for overseas transportation applications, which is not possible for traditional pallet materials without expensive and/or labor intensive coating and/or treatment requirements.

In addition to the designs shown in FIGS. 1-17, alternative forklift pallets and/or containers for the transportation industry are proposed with structural reinforcements integrally formed during fabrication. Side openings for insertion of forklift forks are integrally formed during pallet fabrication. Furthermore, various pockets and/or channels for specialized pallet features and/or stacking are proposed to be formed during pallet fabrication.

Figure 18:
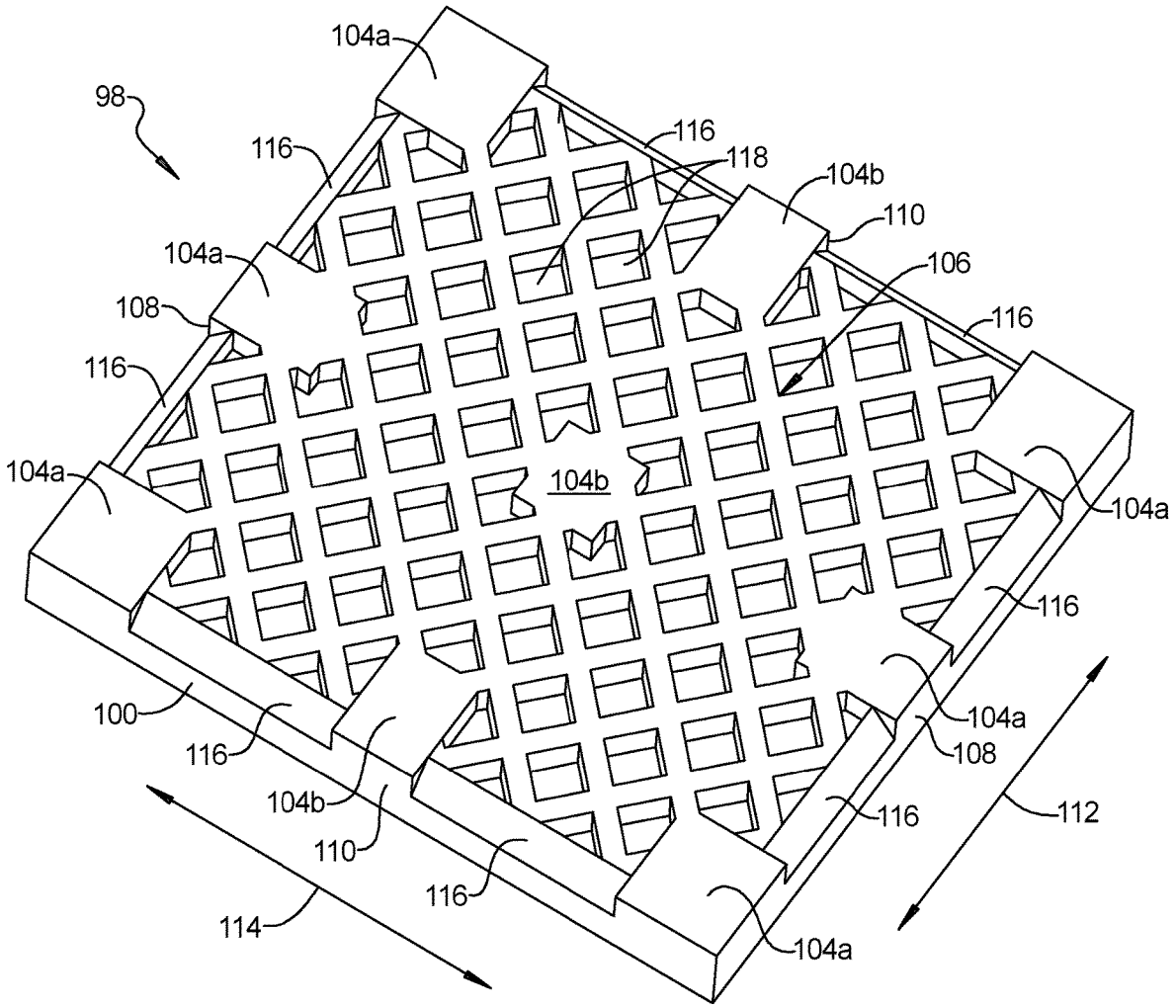
FIG. 18 is a top perspective view of another exemplary pallet constructed in accordance with the present disclosure.
Figure 19:
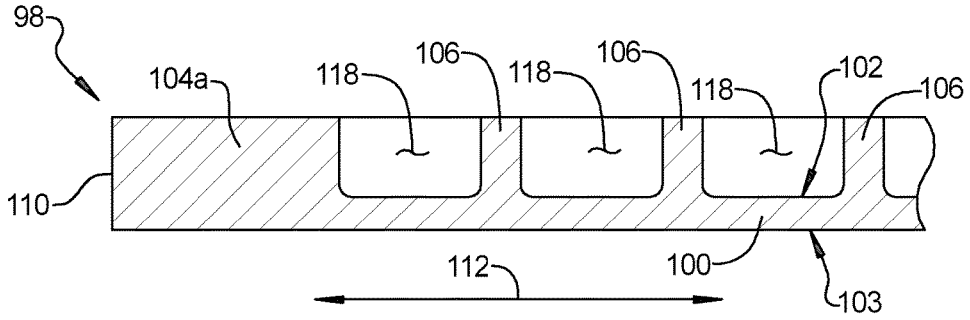
FIG. 19 is a side cross-sectional view of a portion of the exemplary pallet shown in FIG. 18.

One such alternative design is illustrated in FIGS. 18 and 19. The one-piece monolithic pallet structure 98 shown in FIGS. 18 and 19 includes a base plate 100 with upper and lower surfaces 102, 103, block pads 104*a*, 104*b* that protrude from the upper surface 102 of the base plate 100, and a rib web 106 that protrudes from and extends across the upper surface 102 of the base plate 100 between the block pads 104*a*, 104*b*. The base plate 100 has a rectangular shape and the one-piece monolithic pallet structure 98 has a pair of ends 108 and a pair of sides 110. The ends 108 of the one-piece monolithic pallet structure 98 extend laterally (i.e., in the lateral direction 112) between the pair of sides 110. The sides 110 of the one-piece monolithic pallet structure 98 extend longitudinally (i.e., in the longitudinal direction 114) between the pair of ends 108. Optionally, the one-piece monolithic pallet structure 98 may include ramped edges 116 that extend along the pair of ends 108 and the pair of sides 110.

The block pads 104*a*, 104*b* are arranged adjacent to the ends 108 and the sides 110 of the one-piece monolithic pallet structure 98. In addition, at least one block pad 104*b* is arranged at the center of the one-piece monolithic pallet structure 98. The block pads 104*a*, 104*b* may include a first group of block pads 104*a* that are positioned adjacent to the ends 108 of the one-piece monolithic pallet structure 98 and a second group of block pads 104*b* that are positioned longitudinally between the first group of block pads 104*a*. The second group of block pads 104*b* have a smaller perimeter than the first group of block pads 104*a*. Although the number of block pads 104*a*, 104*b* may vary, in accordance with the preferred embodiment illustrated, there are a total of six block pads 104*a* in the first group of block pads 104*a* and there are a total of three block pads 104*b* in the second group of block pads 104*b*. Accordingly, in the illustrated example, there are a total of nine block pads 104*a*, 104*b* that protrude from the base plate 100 of the one-piece monolithic pallet structure 98.

The rib web 106 extends between the block pads 104*a*, 104*b*, across the upper surface 102 of the base plate 100. Although other configurations are possible, the rib web 106 is arranged in a diamond shaped pattern where pockets 118 are formed between the rib web 106 that have a diamond shape. The base plate 100, the block pads 104*a*, 104*b*, and the rib web 106 are integral with one another and are made of a polymeric material. It should be appreciated and understood that the one-piece monolithic pallet structure 98 shown in FIGS. 18 and 19 may be used as a standalone pallet, or alternatively, may be used as the upper platform 22 and/or the lower platform 24 of the pallet 20 shown in FIGS. 1-17. When used in this fashion, the plurality of upper platform pedestals 50*a*, 50*b* and/or the plurality of lower platform pedestals 70*a*, 70*b* extend from or are mounted to the block pads 104*a*, 104*b* of the one-piece monolithic pallet structure 98.

The fabrication processes available for polymeric materials includes casting, pouring, forming, compression, and/or injection, which provides the ability to design and form intricate shapes for brackets, ballistic panels, and/or transportation containers and pallets, which are virtually impossible with the standard materials widely used. As a result, it should be appreciated that the present disclosure is applicable to other structures besides shipping pallets, including brackets and straps used in building construction and ballistic wall panels.

Most reinforcement brackets and/or straps used in the construction of wood frame buildings are stamped sheet metal or other formed metal components. These components will rust and corrode over time unless expensive surface coatings are applied. In addition, the metal components are relatively heavy, which results in excessive shipping cost. Wood frame structures requiring high wind resistance and protection from air borne projectiles must have penetration resistant wall coverings. Steel, concrete, stone, or brick walls can offer a certain amount of penetration resistance, but are only available at a very high price tag to the consumer.

In accordance with the present disclosure, brackets can be formed with integral webs and/or other structural reinforcements designed and fabricated as an integral part of the bracket. The brackets can be formed to include a locating surface designed to mate and match for alignment with the strike face plate of an automatic fastener delivery device such as a pneumatic nail gun. Such brackets may take any one of several different forms such as brackets of various angles, including without limitation, 90 degree (i.e., right angle) brackets. Many other standard angle brackets with angles greater than 90 degrees and/or less than 90 degrees are also contemplated. Such brackets are commonly used in the construction of wood frame structures where hip roof joists connect and other roofing and rafter components connect.

The teachings of the present disclosure can also be applied to straps and/or strapping components, which are formed to wrap over various wood frame components and provide structural reinforcement. Such straps and/or strapping components can be made with reinforcement structures integrally formed into the component. Bolt holes for bolts can be drilled on site and/or formed during fabrication. Nail starter holes can be formed during fabrication. The non-metal bracket and/or strapping material is capable of being nailed through without splitting or cracking even in places where no starter holes exist. In addition, the non-metal fabrication of the disclosed brackets and/or strap components provides corrosion resistant capabilities not possible with traditional metal brackets and/or straps.

Non-metal construction components offer additional benefits because they are rust and corrosion resistant. Therefore, such components are ideal for sand and beach construction applications due to their salt water corrosion resistance. Other corrosive environments can be serviced with specially composed polymeric structural components. In addition to salt water environments, other contaminates can be resisted with appropriately composed polymeric structural components.

A further benefit of polymeric formed structural components is related to the actual weight of the components compared to typical metal components. Polymeric formed structural components can be made much lighter compared to typical steel components. Polymeric formed structural components will range in specific gravity between 0.95-2.0 while steel components will range between 7.0-8.0, which means that steel components are at least 600 percent to 700 percent heavier. As a result, the shipping cost of raw materials for polymeric formed structural components is dramatically reduced as is the shipping cost of finished goods made of polymeric formed structural components. This difference in weight for finished goods provides the added benefit of being able to ship a container full by volume and not be limited by weight before filling the volume out. The net result is more finished goods shipped by volume at a reduced shipping weight, which saves shipping cost and increases the amount of product that can be shipped at one time.

Ballistic wall panels can also be fabricated from polymeric materials with integrally formed stud-like structures to provide exceptional panel stability and resistance to penetration and/or flexing. Such ballistic wall panels can be fabricated in many different size options, like that of sheetrock, dry wall, or plywood panel sizes. The integrally formed stud-like structures on such ballistic wall panels will save significant time and money during the construction of a wood frame building. Furthermore, the ballistic wall panels may include fabricated utility openings that extend laterally through the stud-like structures for wire and plumbing organization and placement. Furthermore, perforated knockouts can be included in the ballistic wall panels to save time and money preparing light switch and/or wall plug openings.

Many modifications and variations of the present invention are possible in light of the above teachings and may be practiced otherwise than as specifically described while within the scope of the appended claims. Those skilled in the art will readily appreciate there are many more potential applications for the polymeric formed structural components than the examples disclosed herein. Furthermore, those skilled in the art will also readily appreciate there are many more materials suitable to use in the formation and fabrication of the polymeric formed structural components than the examples disclosed herein. These antecedent recitations should be interpreted to cover any combination in which the inventive novelty exercises its utility.

What is claimed is:

1. A pallet comprising:

an upper platform extending in and bisected by a first plane;

said upper platform having a pair of upper platform ends, a pair of upper platform sides, an exterior surface, and an interior surface;

said upper platform including a plurality of upper platform pedestals protruding from said interior surface of said upper platform and extending away from said first plane;

a lower platform extending in and bisected by a second plane that is parallel to and spaced apart from said first plane;

said lower platform having a pair of lower platform ends, a pair of lower platform sides, an outside surface, and an inside surface;

said upper and lower platforms being arranged such that said interior surface of said upper platform faces said inside surface of said lower platform;

said lower platform including a plurality of lower platform pedestals protruding from said inside surface of said lower platform and extending away from said second plane;

said lower platform pedestals being aligned with said upper platform pedestals such that said lower platform pedestals and said upper platform pedestals extend towards one another;

a plurality of blocks interlockingly engaged with and extending between said upper and lower platform pedestals; and each block in said plurality of blocks including an upper recess that matches the shape of and receives one of said upper platform pedestals and a lower recess that matches the shape of and receives one of said lower platform pedestals.

2. The pallet as set forth in claim 1, wherein each of said upper and lower platform pedestals is shaped as a rectangular frustum.

3. The pallet as set forth in claim 2, wherein each of said upper and lower platform pedestals includes a cylindrical projection that protrudes from said rectangular frustum.

4. The pallet as set forth in claim 3, wherein each block in said plurality of blocks includes an upper counter-bore located in said upper recess that is aligned with and receives said cylindrical projection of one of said upper platform pedestals and a lower counter-bore located in said lower recess that is aligned with and receives said cylindrical projection of one of said lower platform pedestals.

5. The pallet as set forth in claim 4, wherein said upper and lower recesses give said plurality of blocks a bow-tie like cross-sectional shape.

6. The pallet as set forth in claim 1, wherein said plurality of upper platform pedestals includes a first group of upper platform pedestals that are positioned adjacent to said pair of upper platform ends and a second group of upper platform pedestals that are positioned longitudinally between said first group of upper platform pedestals and that have a smaller perimeter than said first group of upper platform pedestals.

7. The pallet as set forth in claim 6, wherein said plurality of lower platform pedestals includes a first group of lower platform pedestals that are positioned adjacent to said pair of lower platform ends and a second group of lower platform pedestals that are positioned longitudinally between said first group of lower platform pedestals and that have a smaller perimeter than said first group of lower platform pedestals.

8. The pallet as set forth in claim 7, wherein said plurality of blocks includes a group of end blocks that are positioned adjacent to said upper and lower platform ends and a group of middle blocks that are positioned longitudinally between said group of end blocks and that have a smaller perimeter than said group of end blocks, said group of end blocks being aligned with and extending between said first group of upper platform pedestals and said first group of lower platform pedestals, and said group of middle blocks being aligned with and extending between said second group of upper platform pedestals and said second group of lower platform pedestals.

9. The pallet as set forth in claim 8, wherein there are six pedestals in said first group of upper platform pedestals and there are three pedestals in said second group of upper platform pedestals such that there are a total of nine pedestals in said plurality of upper platform pedestals, wherein there are six pedestals in said first group of lower platform pedestals and there are three pedestals in said second group of lower platform pedestals such that there are a total of nine pedestals in said plurality of lower platform pedestals, and wherein there are six blocks in said group of end blocks and there are three blocks in said group of middle blocks such that there are a total of nine blocks in said plurality of blocks.

10. The pallet as set forth in claim 1, wherein said pair of upper platform ends extend laterally between said pair of upper platform sides, said pair of upper platform sides extend longitudinally between said pair of upper platform ends, and said upper platform includes a plurality of slots extending therethrough that run parallel to said upper platform ends and are arranged in two laterally spaced apart groups.

11. The pallet as set forth in claim 10, wherein said plurality of upper platform pedestals are arranged adjacent to said upper platform ends and said upper platform sides and wherein at least one pedestal in said plurality of upper platform pedestals is arranged between said laterally spaced apart groups of said slots.

12. The pallet as set forth in claim 1, wherein said pair of lower platform ends extend laterally between said pair of lower platform sides, said pair of lower platform sides extend longitudinally between said pair of lower platform ends, and said lower platform includes a pair of openings extending therethrough that are spaced apart and are rectangular in shape.

13. The pallet as set forth in claim 12, wherein said plurality of lower platform pedestals are arranged adjacent to said lower platform ends and said lower platform sides and wherein at least one pedestal in said plurality of lower platform pedestals is arranged between said openings in said lower platform.

14. The pallet as set forth in claim 1, wherein said upper platform, said lower platform, and said plurality of blocks are made of a polymeric material.

15. A pallet comprising:

an upper platform extending in and bisected by a first plane;

said upper platform having a pair of upper platform ends, a pair of upper platform sides, an exterior surface, and an interior surface;

said upper platform including a plurality of upper platform pedestals protruding from said interior surface of said upper platform and extending away from said first plane;

said upper platform including a plurality of upper platform holes aligned with and extending through said plurality of upper platform pedestals;

a lower platform extending in and bisected by a second plane that is parallel to and spaced apart from said first plane;

said lower platform having a pair of lower platform ends, a pair of lower platform sides, an outside surface, and an inside surface;

said upper and lower platforms being arranged such that said interior surface of said upper platform faces said inside surface of said lower platform;

said lower platform including a plurality of lower platform pedestals protruding from said inside surface of said lower platform and extending away from said second plane;

said lower platform pedestals being aligned with said upper platform pedestals such that said lower platform pedestals and said upper platform pedestals extend towards one another;

said lower platform including a plurality of lower platform holes aligned with and extending through said plurality of lower platform pedestals;

a plurality of blocks interlockingly engaged with and extending between said upper and lower platform pedestals;

said upper platform, said lower platform, and said plurality of blocks being made of a polymeric material;

each block in said plurality of blocks including an upper recess that matches the shape of and receives one of said upper platform pedestals, a lower recess that matches the shape of and receives one of said lower platform pedestals, and a through-bore that is aligned with one of said upper platform holes and one of said lower platform holes; and a plurality of fasteners aligned with and extending through said plurality of upper platform holes, said through-bores in said plurality of blocks, and said plurality of lower platform holes to secure said upper platform, said lower platform, and said plurality of blocks together.

16. The pallet as set forth in claim 15, wherein each of said upper and lower platform pedestals includes a cylindrical projection.

17. The pallet as set forth in claim 16, wherein each block in said plurality of blocks includes an upper counter-bore located in said upper recess that is aligned with and receives said cylindrical projection of one of said upper platform pedestals and a lower counter-bore located in said lower recess that is aligned with and receives said cylindrical projection of one of said lower platform pedestals.

18. The pallet as set forth in claim 17, wherein said through-bore in each block extends between said upper and lower counter-bores.

19. The pallet as set forth in claim 18, wherein each of said upper and lower platform pedestals is shaped as a rectangular frustum.

20. A pallet comprising:

an upper platform extending in and bisected by a first plane;

said upper platform having a rectangular shape with a pair of upper platform ends, a pair of upper platform sides, an exterior surface that is parallel to said first plane, and an interior surface that is parallel to said first plane and that is spaced apart from said exterior surface by an upper platform thickness;

said pair of upper platform ends extending laterally between said pair of upper platform sides and said pair of upper platform sides extending longitudinally between said pair of upper platform ends;

said upper platform including a plurality of slots extending therethrough that are spaced apart and that run parallel to said upper platform ends;

said plurality of slots being arranged in said upper platform in laterally spaced apart groups;

said upper platform including a plurality of upper platform pedestals that are arranged adjacent to said upper platform ends and said upper platform sides and where at least one pedestal in said plurality of upper platform pedestals is arranged between said laterally spaced apart groups of said slots;

each upper platform pedestal protruding from said interior surface of said upper platform and extending away from said first plane;

said plurality of upper platform pedestals including a first group of upper platform pedestals that are positioned adjacent to said pair of upper platform ends and a second group of upper platform pedestals that are positioned longitudinally between said first group of upper platform pedestals and that have a smaller perimeter than said first group of upper platform pedestals;

said upper platform including a plurality of upper platform holes that are arranged adjacent to said upper platform ends and said upper platform sides and where at least one hole in said plurality of upper platform holes is arranged between said laterally spaced apart groups of said slots;

said plurality of upper platform holes being aligned with and extending through said plurality of upper platform pedestals such that each upper platform pedestal includes one of said upper platform holes;

a lower platform extending in and bisected by a second plane that is parallel to and spaced apart from said first plane;

said lower platform having a rectangular shape with a pair of lower platform ends, a pair of lower platform sides, an outside surface that is parallel to said second plane, and an inside surface that is parallel to said second plane and is spaced from said outside surface by a lower platform thickness;

said upper and lower platforms being arranged such that said interior surface of said upper platform faces said inside surface of said lower platform;

said pair of lower platform ends extending laterally between said pair of lower platform sides and said pair of lower platform sides extending longitudinally between said pair of lower platform ends;

said lower platform including a pair of openings extending therethrough that are spaced apart and rectangular in shape;

said lower platform including a plurality of lower platform pedestals that are arranged adjacent to said lower platform ends and said lower platform sides and where at least one pedestal in said plurality of lower platform pedestals is arranged between said openings in said lower platform;

each lower platform pedestal protruding from said inside surface of said lower platform and extending away from said second plane;

said lower platform pedestals being aligned with said upper platform pedestals such that said lower platform pedestals and said upper platform pedestals extend towards one another;

said plurality of lower platform pedestals including a first group of lower platform pedestals that are positioned adjacent to said pair of lower platform ends and a second group of lower platform pedestals that are positioned longitudinally between said first group of lower platform pedestals and that have a smaller perimeter than said first group of lower platform pedestals;

said lower platform including a plurality of lower platform holes that are arranged adjacent to said lower platform ends and said lower platform sides and where at least one hole in said plurality of lower platform holes is arranged between said openings in said lower platform;

said plurality of lower platform holes being aligned with and extending through said plurality of lower platform pedestals such that each lower platform pedestal includes one of said lower platform holes;

said plurality of lower platform holes being aligned with said plurality of upper platform holes;

each of said upper and lower platform pedestals being shaped as a rectangular frustum with a cylindrical projection that is centrally located on said rectangular frustum and extends annularly about one of said upper platform hole or said lower platform hole in said pedestal;

a plurality of blocks interlockingly engaged with and extending between said upper and lower platform pedestals;

each block in said plurality of blocks having a rectangular shape and including an upper recess that matches the shape of and receives one of said upper platform pedestals and a lower recess that matches the shape of and receives one of said lower platform pedestals;

said upper and lower recesses giving said plurality of blocks a bow-tie like cross-sectional shape;

each block in said plurality of blocks having an upper counter-bore centrally located in said upper recess that is aligned with and receives said cylindrical projection of one of said upper platform pedestals, a lower counter-bore centrally located in said lower recess that is aligned with and receives said cylindrical projection of one of said lower platform pedestals, and a through-bore that extends between said upper and lower counter-bores;

said plurality of blocks including a group of end blocks that are positioned adjacent to said upper and lower platform ends and a group of middle blocks that are positioned longitudinally between said group of end blocks and that have a smaller perimeter than said group of end blocks;

said group of end blocks being aligned with and extending between said first group of upper platform pedestals and said first group of lower platform pedestals and said group of middle blocks being aligned with and extending between said second group of upper platform pedestals and said second group of lower platform pedestals;

said upper platform, said lower platform, and said plurality of blocks being made of a polymeric material; and a plurality of fasteners aligned with and extending through said plurality of upper platform holes, said through-bores in said plurality of blocks, and said plurality of lower platform holes to secure said upper platform, said lower platform, and said plurality of blocks together.

* * * * *